US005317475A

United States Patent [19]

Siepmann

[11] Patent Number: 5,317,475

[45] Date of Patent: May 31, 1994

[54] CIRCUIT ARRANGEMENT FOR DRIVING A GROUP OF RELAYS

[75] Inventor: Richard Siepmann, Munich, Fed. Rep. of Germany

[73] Assignee: Siemens Aktiengesellschaft, Munich, Fed. Rep. of Germany

[21] Appl. No.: 698,497

[22] Filed: May 3, 1991

[30] Foreign Application Priority Data

Aug. 21, 1990 [DE] Fed. Rep. of Germany ..... 4026427

[51] Int. Cl.[5] ..... H01H 47/32

[52] U.S. Cl. ..... 361/154; 361/191

[58] Field of Search ..... 307/131, 31, 10.1; 361/154, 155, 166, 152, 187, 191; 123/490

[56] References Cited

U.S. PATENT DOCUMENTS

| | | | |
|---|---|---|---|
| Re. 31,391 | 9/1983 | Davis et al. | 361/154 |
| 4,180,026 | 12/1979 | Schulzke | 361/154 X |
| 4,227,230 | 10/1980 | Bray | 361/152 |
| 4,266,261 | 5/1981 | Streit et al. | 361/154 |
| 4,295,177 | 10/1981 | Woodhouse et al. | 361/154 |
| 4,417,201 | 11/1983 | Reddy | 361/154 X |
| 4,905,120 | 2/1990 | Grembowicz et al. | 361/154 |
| 4,944,281 | 7/1990 | Suquet | 361/154 X |
| 4,978,865 | 12/1990 | Hartmann et al. | 361/154 X |
| 5,107,391 | 4/1992 | Siepmann | 361/168 |
| 5,113,307 | 5/1992 | Meyer et al. | 361/154 |

FOREIGN PATENT DOCUMENTS

| | | |
|---|---|---|
| 0392058 | 10/1990 | European Pat. Off. . |
| 2000117 | 7/1971 | Fed. Rep. of Germany . |
| 3331678 | 4/1985 | Fed. Rep. of Germany . |
| 3615908 | 11/1987 | Fed. Rep. of Germany . |
| 3925767 | 8/1989 | Fed. Rep. of Germany . |

OTHER PUBLICATIONS

Patent Abstracts of Japan, vol. 8, No. 139 (E-253)(1576) 28. Jun. 1984, Matsushita.

*Primary Examiner*—Jeffrey A. Gaffin
*Assistant Examiner*—F. M. Fleming
*Attorney, Agent, or Firm*—Hill, Steadman & Simpson

[57] ABSTRACT

A circuit arrangement for driving a group of relays includes a voltage regulator for supplying a normal holding voltage and for supplying a briefly increased pick-up voltage upon connection of each additional relay. An ammeter recognizes the increase in current as the result of the connection of each additional relay and generates a control signal to the voltage regulator for increasing the voltage. Simple and effective control of the relays without high heat loss is thus achieved without requiring individual sensor lines and the like.

11 Claims, 2 Drawing Sheets

CIRCUIT ARRANGEMENT FOR DRIVING A GROUP OF RELAYS

BACKGROUND OF THE INVENTION

1. Field of the Invention

The present invention is directed generally to a circuit for operating a group of relays which are driven by a common drive voltage.

2. Description of the Related Art

In electromagnetic relays which have a winding for attracting an armature, there is a general problem in that the windings require a relatively high pick-up excitation signal, particularly given temperature fluctuations and given fluctuations in the supply voltage. Once the armature of the relay is attracted, a significantly lower holding excitation signal is adequate to maintain the relay in the "on" condition. Thus, if the high pick-up voltage also termed pick-up voltage is applied during the continuous operation of the relay, an unnecessarily high amount of energy is consumed and the relay is undesirably heated.

To drive individual relays, it has long been known to lower the pick-up voltage to a lesser holding voltage after the attraction of the armature. This may be accomplished, for example, through the use of a mere time control which switches to the holding voltage after a pick-up pulse of a defined duration. Instead, the successful attraction of the armature can be positively identified and, thus, the switch to the lower holding voltage may be undertaken only after the armature is successfully attracted. According to German Patent Document DE 36 15 908 A1, a decrease in the current at the moment the magnetic circuit of the armature closes is identified and evaluated for switching to the lower voltage. In another German Patent Document DE 39 25 726 A1 is disclosed the sensing of the excitation current as well as of the excitation voltage and then increasing or reducing the current through the relay winding dependent upon these two values. The known drive circuits, however, are each designed only for operating an individual relay so that the entire circuit must be repeated for each relay given the operation of a number of relays at different times.

Although German Patent Document DE 33 31 678 C2 discloses a circuit arrangement for driving a number of relays which are optionally operable in parallel, a separate drive module is again required. The separate drive module applies the attraction pulses and holding pulse sequences which are generated in a common drive means to the respective relay winding. Here, too, a considerable circuit outlay is involved which is increased with each additional relay used.

The foregoing problem is particularly acute in relays operated in motor vehicles due to the high temperature differences which prevail and the wide fluctuations of battery voltages in such applications.

SUMMARY OF THE INVENTION

An object of the present invention is to supply a group of individually operable relays with a response or switching voltage or a reduced holding voltage as needed, while keeping circuit costs low. A further object of the invention is to keep the circuit outlay for a circuit driving a group of relays independent of the number of relays operated thereby.

These and other objects and advantages of the invention are achieved by a circuit arrangement including:

dependent upon a control signal, a voltage regulator optionally applies a drive voltage in the form of a low holding voltage or a higher pick-up voltage to the windings of all connected relays;

upon the connection of an additional relay to the voltage regulator, a current sensing means measures a boost in the current which is associated therewith and generates a control signal for the voltage regulator from the current boost; and when the control signal is received, the voltage regulator applies the pick-up voltage for a predetermined time span but otherwise constantly applies the holding voltage to the windings of the relay group.

Thus, the interrogation of each and every individual relay and the identification of its operating condition to supply an individual pick-up or pick-up, voltage in place of the holding voltage is avoided. The necessity of sensor lines between the control means and the relays which are employed at various locations is, thus, also eliminated. Instead, only the overall current through the parallel connected windings is measured according to the present invention. The present invention uses the sudden increase in current in the common supply line which results from the operation of an additional relay to indicate the need for the pick-up voltage. When such an increase in current is identified, the drive voltage on the common supply line is briefly increased and the newly activated relay is, thus, provided with the required pick-up voltage in all cases. It is of little consequence that the other relays also again unnecessarily receive the pick-up voltage for a brief time, particularly when compared to the savings in control lines and circuit elements achieved by the present invention.

In some embodiments, the operating voltage supplied by the present circuit is generally a DC voltage having different voltage levels for the pick-up voltage and for the holding voltage. In other embodiments, a clocked voltage may be used so that the difference between the pick-up voltage and the holding voltage may lie in differences in either the amplitude or in the pulse-duty factor, or both.

An advantageous development in the circuit arrangement of the present invention provides that the current sensing means includes a differential amplifier which measures a voltage across a resistor which has been inserted in series in the common power supply circuit to the relay windings. The current sensing means generates a control signal upon detection of an increase in the current to the relay windings.

In an alternate advantageous development, the current sensing means includes a transistor which has been connected into the power supply circuit of the relay windings. The transistor is capable of being re-adjusted to a constant voltage drop via a control circuit in a delayed fashion, wherein the re-adjustment signal for the transistor is derived from a temporary voltage increase. The control signal for the voltage regulator is derived from the re-adjustment signal. This second embodiment is especially advantageous when a large number of relays are to be monitored, since the overall current, and thus, the number of connected relays has no influence on the size of the re-adjustment signal.

In the circuit arrangement of the invention, in general, the time constant of the current sensing means is selected so that the current increase upon activation of a relay is recognized when a current decrease occurs due to the simultaneous deactivation of another relay. A useable control signal can also be acquired in this case on the basis of a corresponding dimensioning of the time constant, since the current drops more rapidly upon disconnection of a relay than the current increases given activation of a relay, so that the brief duration drop in the current need merely to be taken into consideration during the selection of the time constant.

As mentioned above, the power control according to the present invention for a group of relays eliminates sensor lines for the individual relays which are generally arranged at various locations. Over and above this, of course, the many input lines for the voltage regulator which would otherwise be required are also eliminated. This is a significant savings since each of the input lines to the voltage regulator must be equipped with protective wiring to counter noise spikes of, for example, more than 100 volts. A further significant advantage of the present invention is that the number of relays to be controlled need not be defined initially when selecting and using the circuit.

Exemplary embodiments of the invention shall be set forth in greater detail below with reference to the drawings.

DETAILED DESCRIPTION OF THE PREFERRED EMBODIMENTS

Figure 1:
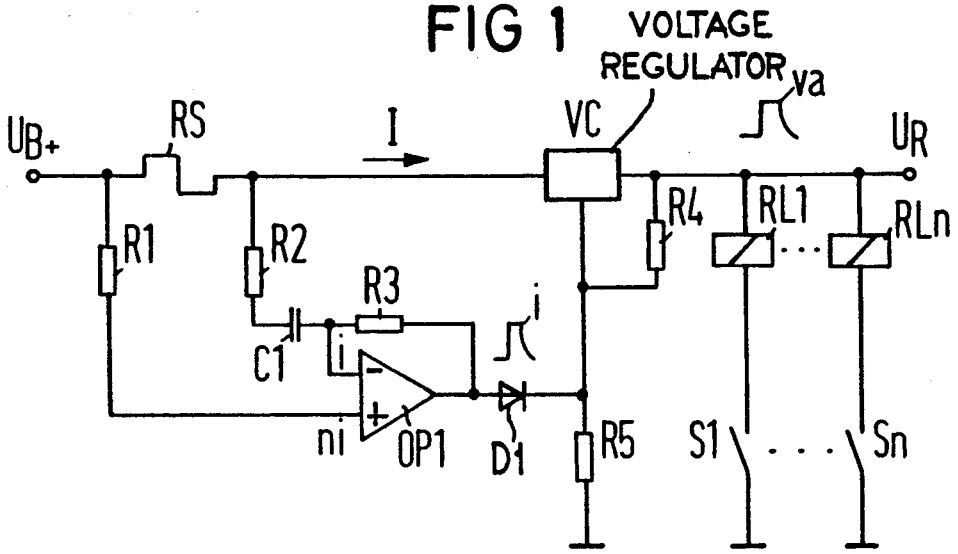
FIG. 1 is a circuit diagram of a circuit arrangement for driving a plurality of relays according to the principles of the present invention, wherein the circuit arrangement includes a first embodiment of a current sensing means.

In FIG. 1, a group of relays RL1 through RLn is provided with the corresponding relay windings connected in parallel across a regulated relay voltage $U_R$. Each of the relays in the relay group RL1 through RLn are individually activatable and deactivatable independently of one another via corresponding switches S1 through Sn connected in series with each corresponding relay.

Connected to the relay group RL1 through RLn is a circuit arrangement according to the present invention for supplying an operating voltage, such as a battery voltage $U_B$ of a motor vehicle to the relays RL1 through RLn. The operating voltage $U_B$ is to be regulated so that the relays are always reliably activated and deactivated independently of one another but do not receive an unnecessarily high current when in the holding condition. For this purpose, a voltage regulator VC applies the regulated relay voltage $U_R$ to the relay group. The regulated voltage $U_R$ is generally a relatively low holding voltage which is adequate for holding the armatures of the relays to their respective windings. However, at the moment when an additional relay of the relay group R11 through RLn is connected, the regulated voltage $U_R$ is briefly elevated, as indicated by pulse va.

In addition to the voltage regulator VC, the circuit arrangement of FIG. 1 also includes an current sensing means which includes a shunt, or precision resistor, RS connected in series in the common supply line for the relay group RL1 through RLn. The current sensing means recognizes the connection of an additional relay in the relay group by taking a voltage across the shunt resistor RS through resistors R1 and R2 and via a decoupling capacitor C1. The shunt voltage is then supplied to the inputs of an operational amplifier OP1 which has been connected as a voltage follower including a feedback resistor R3. Any changes in the voltage across the resistor Rs which occur as a result of an increase in the current drawn by the relay group RL1 through RLn generates a pulse i at the output of the operational amplifier OP1. The pulse i is of a predetermined time duration corresponding to the time required for activation of any of the relays in the relay group RL1 through RLn. The pulse i is supplied through a diode D1 to an input of the voltage regulator VC, thereby causing the voltage regulator VC to increase the voltage $U_R$ supplied to the relay group for the duration of the pulse i Resistors R4 and R5 serve for feedback or as a compound resistor for the input of the voltage regulator.

Voltage changes across the shunt resistor RS are, thus, amplified by the current sensor in FIG. 1 and the signal is overlayed on the measuring path of the voltage regulator VC so that the output voltage increases briefly in the form of a voltage pulse va.

Figure 2:
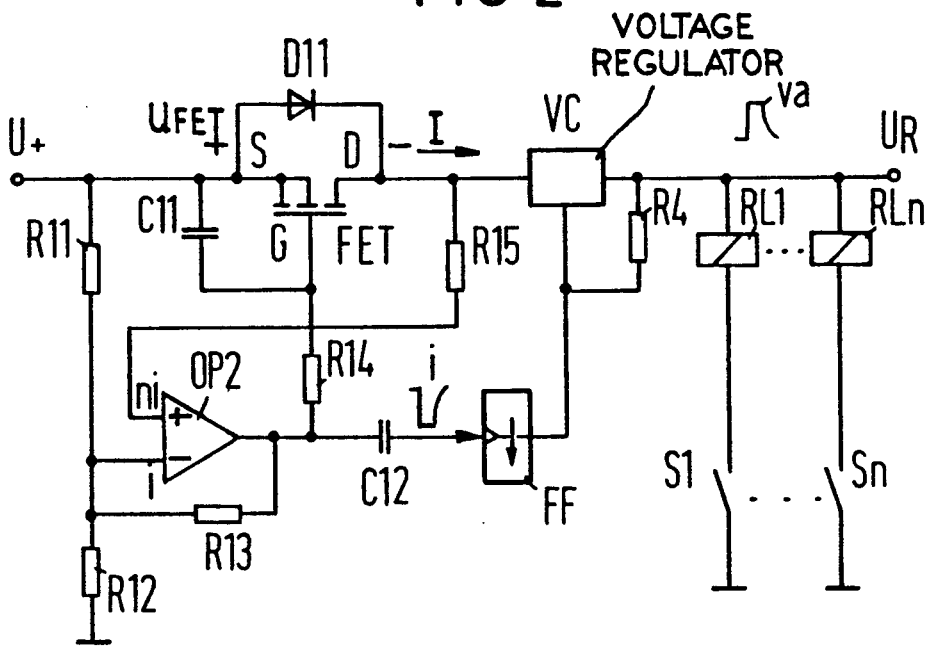
FIG. 2 is a circuit diagram of a modified circuit arrangement having a second embodiment of current sensing means.

Another possibility for recognizing a current increase resulting from the connection of a relay in a relay group is shown in FIG. 2. In the second embodiment, a field effect transistor FET has a source-drain path connected into the current path of the relay group RL1 through RLn which is, as in the embodiment of FIG. 1, connected to the voltage regulator VC. An operational amplifier OP2 is provided to adjust the transistor FET to a constant voltage via resistors R11 through R15. In the adjusted condition the equation $$R_{FET}=U_{FET}/I$$

applies for the resistance of the field effect transistor FET.

An increases in the current in the excitation circuit briefly affects an increases in the voltage $U_{FET}$ across the field effect transistor FET which, however, is limited by the parallel diode D11. This increases in voltage is then leveled by the operational amplifier OP2 by the application of a re-adjust signal applied to the gate electrode G of the transistor FET via a resistor R14. The re-adjust signal is supplied to a flip-flop FF as a pulse i via a capacitor C12, and the flip-flop FF supplies the pulse i to the voltage regulator VC as a control signal. A capacitor C11 is connected in parallel to the source-gate path of the transistor FET and thereby acts to delay the re-adjustment and thus ensure an adequately long control signal pulse. The measuring circuit of FIG. 2 incorporating the field effect transistor FET always identifies an increases in voltage, and the increases in voltage may be largely independent of the overall size of the excitation current whereas the measured value is dependent on the overall current in the measuring circuit using the shunt resistor Rs of FIG. 1. Therefore, the embodiment of FIG. 2 is especially suitable for applications having a large number of relays connectable in extremely different combinations.

Figure 3A:
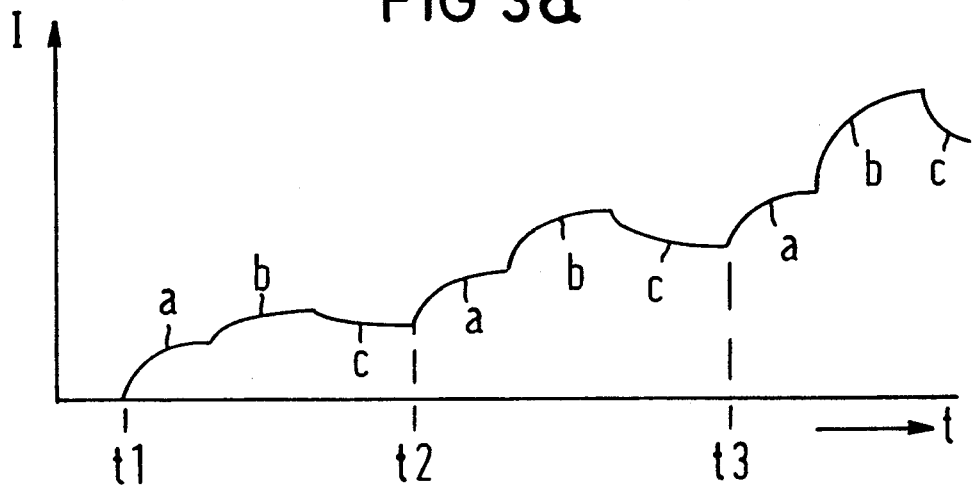
FIG. 3*a* is a graph of winding current to a group of parallel connected relays under the control of a circuit arrangement of the present invention.
Figure 3B:
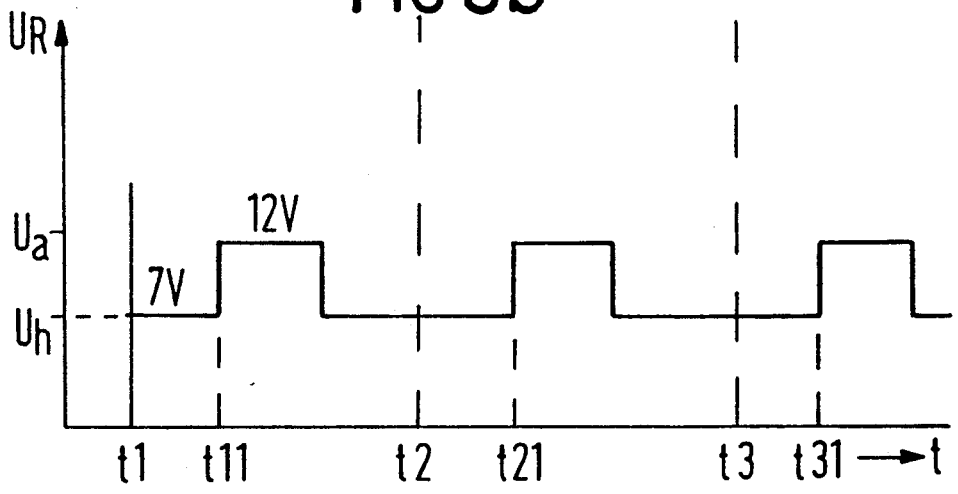
FIG. 3*b* is a graph of the voltage across a parallel connected group of relays controlled by a circuit arrangement of the invention, wherein times in FIG. 3*b* correspond to times shown on the current graph of FIG. 3*a*.

FIGS. 3*a* and 3*b* show current and voltage curves, respectively, applied to a relay group under control of a circuit according to the present invention. In FIG. 3*a* is shown a curve of current over time t. For purposes of the present example, it is assumed that relay windings are activated at times t1, t2 and t3. The resulting current from the parallel connected windings describes the illustrated curve, wherein an increases in the current in curve sections a is recognized by the current sensing means according to either FIGS. 1 or 2. As shown in FIG. 3*b*, the regulated relay voltage $U_R$ is boosted from a lower holding voltage $U_h$ to a higher pick-up voltage $U_a$, for example from 7 volts to 12 volts, at t11, t21 and t31 in response to the an increases in current at sections a. The boost in voltage also results in a increase in the current, as seen in FIG. 3*a* at the curve sections b. After a prescribed pulse duration, the voltage is again lowered to a holding voltage $U_h$, and as a result thereof, the current again decreases as can be seen in curve sections c in FIG. 3*a*.

Thus, there is shown and described a low power drive for a group of relays in which a lower holding voltage is applied during normal operation and a brief increased pick-up voltage is applied during connection of additional relays. The connection of an additional relay is recognized by an increase in current to the parallel connected relays, which increases is sensed by an current sensing, which generates a control signal to a voltage regulator.

This enables the operating voltage of an arbitrary number of individually operable relays which are used at different locations to be controlled in a simple way without high heat dissipation. Further, the status and individual voltage regulation of the relays need not be monitored and sensor lines are eliminated so that the overall outlay for the present circuit is low.

Although other modifications and changes may be suggested by those skilled in the art, it is the intention of the inventor to embody within the patent warranted hereon all changes and modifications as reasonably and properly come within the scope of his contribution to the art.

I claim:

1. A circuit arrangement for controlled operating of a group of relays driven by a common drive voltage, comprising:

switching means for activating and deactivating individually each of the relays;

a voltage regulator having an input for receiving a control signal and an output connected to the group of relays to supply a holding voltage to the group of relays in the absence of the control signal and to supply an increased pick-up voltage to the group of relays when the control signal is received at said input; and a current sensing means for detecting an increase in total current flowing through the group of relays resulting from activation of an additional relay and for transmitting for a predetermined period of time the control signal to said input of said voltage regulator upon detection of the increase in current.

2. A circuit arrangement as claimed in claim 1, wherein said current sensing means comprises:

a resistor in series with a common power supply to windings of the group of relays; and a differential amplifier having inputs connected across said resistor to sense voltages across said resistor and generate the control signal upon a increase in current through said resistor.

3. A circuit arrangement as claimed in claim 1, wherein said current sensing means comprises:

a transistor connected to a common power supply in series with parallel connected windings of the group of relays to cause a temporary increase in voltage across the transistor upon the increase in current resulting from activation of an additional relay;

a control circuit including means for comparing the voltage of the transistor to a predetermined voltage to thereby generate a re-adjust signal that is connected to said transistor to re-adjust said transistor to a constant voltage following a predetermined delay after the temporary increase in voltage, the a re-adjust signal being derived from the temporary increase in voltage, the control signal for the voltage regulator being derived from the re-adjust signal to temporarily supply pick-up voltage to the relays.

4. A circuit arrangement as claimed in claim 3, wherein said transistor is a field effect transistor, and further comprising:

a voltage divider connected to a source electrode of said field effect transistor at the common power supply; and an operational amplifier having a first input connected to a middle tap of said voltage divider and a second input connected to a drain electrode of said field effect transistor, said operational amplifier having an output connected to a gate of said field effect transistor to apply a gate voltage, the gate voltage being coupled out as the control signal.

5. A circuit arrangement as claimed in claim 4, further comprising:

a diode connected parallel to said field effect transistor to limit a voltage increase across said field effect transistor.

6. A circuit arrangement as claimed in claim 4, further comprising:

a capacitor connected parallel to a source-gate path of said field effect transistor to delay the re-adjust signal to the field effect transistor.

7. A circuit arrangement as claimed in claim 1, wherein said voltage regulator is a DC voltage regulator for emitting DC holding voltage and a DC pick-up voltage.

8. A circuit arrangement as claimed in claim 1, wherein said voltage regulator is a pulse voltage regulator for emitting pulsed voltages.

9. A circuit arrangement as claimed in claim 8, wherein said pulse voltage regulator is a constant pulse voltage regulator.

10. A circuit arrangement as claimed in claim 8, wherein said pulse voltage regulator is a variable pulse-duty voltage regulator.

11. A circuit arrangement as claimed in claim 6, wherein said delay caused by said capacitor is such that evaluation of a current increase from activation of a relay of the relay group and generation of said control signal occurs even when another relay of the relay group simultaneously is deactivated and thereby causes a decrease in the current.

* * * * *